US007943217B2

(12) United States Patent
Baumgartner

(10) Patent No.: US 7,943,217 B2
(45) Date of Patent: May 17, 2011

(54) FIRE PROTECTION DEVICE FOR A CABLE OR THE LIKE OF A CIVIL ENGINEERING OR A STRUCTURAL WORK

(75) Inventor: Jérémie Baumgartner, Saint-Maur (FR)

(73) Assignee: Efiffage TP, Neuilly sur Marne (FR)

( * ) Notice: Subject to any disclaimer, the term of this patent is extended or adjusted under 35 U.S.C. 154(b) by 466 days.

(21) Appl. No.: 12/223,859

(22) PCT Filed: Feb. 14, 2007

(86) PCT No.: PCT/FR2007/000261

§ 371 (c)(1),
(2), (4) Date: Aug. 12, 2008

(87) PCT Pub. No.: WO2007/093703

PCT Pub. Date: Aug. 23, 2007

(65) Prior Publication Data

US 2010/0154147 A1 Jun. 24, 2010

(30) Foreign Application Priority Data

Feb. 17, 2006 (FR) ..... 06 01428

(51) Int. Cl.

| | |
|---|---|
| ***A47G 19/22*** | (2006.01) |
| ***B28B 21/00*** | (2006.01) |
| ***B28B 21/72*** | (2006.01) |
| ***B28B 23/08*** | (2006.01) |

(52) U.S. Cl. ..... 428/34.5; 428/34.1; 428/920; 428/921; 14/22; 169/48

(58) Field of Classification Search ..... 428/34.5, 428/34.1, 920, 921; 14/22; 169/48
See application file for complete search history.

(56) References Cited

U.S. PATENT DOCUMENTS

| | | | | |
|---|---|---|---|---|
| 4,510,348 | A | 4/1985 | Arroyo et al. | |
| 4,844,960 | A * | 7/1989 | Spriggs et al. | 428/34.5 |
| 5,985,385 | A * | 11/1999 | Gottfried | 428/34.6 |
| 6,074,714 | A | 6/2000 | Gottfried | |
| 6,610,399 | B1 | 8/2003 | Crigler | |
| 2003/0194931 | A1 | 10/2003 | Crigler | |
| 2005/0252675 | A1 * | 11/2005 | Lecino et al. | 174/100 |
| 2006/0051035 | A1 | 3/2006 | Cavill | |

FOREIGN PATENT DOCUMENTS

| | | |
|---|---|---|
| EP | 1 207 242 | 5/2002 |
| WO | 2004/048832 | 6/2004 |

OTHER PUBLICATIONS

International Search Report issued Aug. 3, 2007 in the International (PCT) Application of which the present application is the U.S. National Stage.

* cited by examiner

*Primary Examiner* — Norca L Torres-Velazquez
(74) *Attorney, Agent, or Firm* — Wenderoth, Lind & Ponack, L.L.P.

(57) ABSTRACT

A protective device (10) for use in the protection of at least a portion of an elongated article (50) which includes a main body (12), first and second parts (22), (27) which are connectible together such that, in an assembled position the main body has a chamber therein (14). The first and second parts each have two longitudinal extending side edge portions (23), (28), respective side edge portions of the first part being adapted to cooperate with the respective side edge portions of the second part to connect the two parts together in the assembled position.

14 Claims, 2 Drawing Sheets

FIRE PROTECTION DEVICE FOR A CABLE OR THE LIKE OF A CIVIL ENGINEERING OR A STRUCTURAL WORK

The present invention relates to a fire protection device for a cable or the like of a civil engineering or structural work, the device being of the type comprising a blanket of thermally insulating material wound around the cable.

The invention applies in particular to cables for holding bridge decks such as stayed or extradosed cables, and also to prestressed cables extending on the outside of the concrete of the bridge deck.

The term "cable or the like" is used herein to mean overhead metal elements working in traction in civil engineering and structural works, such as cables, bars, ties, or metal hangers. All such elements are covered below generically by the term "cable", and the invention is described in the context of cables for supporting bridge decks.

Specifications for building bridges include fire protection requirements for cables that support a bridge deck. For example, exposing a cable to a temperature of 1000° C. for one hour should not lead to the temperature of the cable itself rising above 100° C.

Various solutions have been proposed to satisfy those requirements. In particular, there exists a structure comprising two tubes placed one within the other and having an intermediate layer made of refractory mortar or of a material based on needled ceramic fibers.

Nevertheless, those known solutions are difficult to carry out and expensive, and the device is very heavy.

Furthermore, it is known to use fire protection blankets in a variety of applications, but no implementation thereof has yet been proposed that is adapted to the special conditions that apply to cables of suspension bridges.

An object of the invention is to provide a solution that is inexpensive, reliable, and easy to implement, even around cables that are already in place, and that is capable of satisfying the most severe requirements in terms of fire safety.

To this end, the invention provides a fire protection device of the above-specified type and characterized by the characterizing portion of claim 1.

Other characteristics of the device of the invention are specified in claims 2 to 11.

The invention also provides a civil engineering or structural work of the type comprising a cable structure, the work being characterized in that at least one cable or the like of the cable structure is provided with a fire protection device as described hereinabove. The term "cable structure" should be broadly understood as explained above concerning the term "cable or the like".

In particular, the invention provides a bridge of the type comprising a deck, pylons, and a set of cables or the like for suspending the deck from the pylons, the bridge being characterized in that at least one cable is provided with a fire protection device as defined above.

In a particular embodiment of the bridge, the pylon associated with said cable includes in its top portion a cable-deflector tube, and the protection device extends onto the deflector tube.

An embodiment of the invention is described below with reference to the accompanying drawings, in which.

Figure 1:
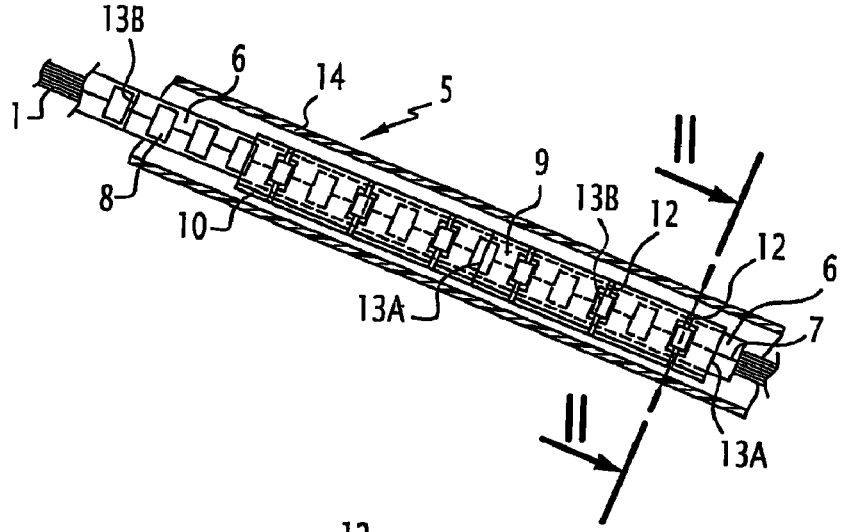
FIG. 1 is a cutaway diagrammatic view of a cable or the like for a civil engineering or structural bridge work that is provided with a fire protection device of the invention.
Figure 2:
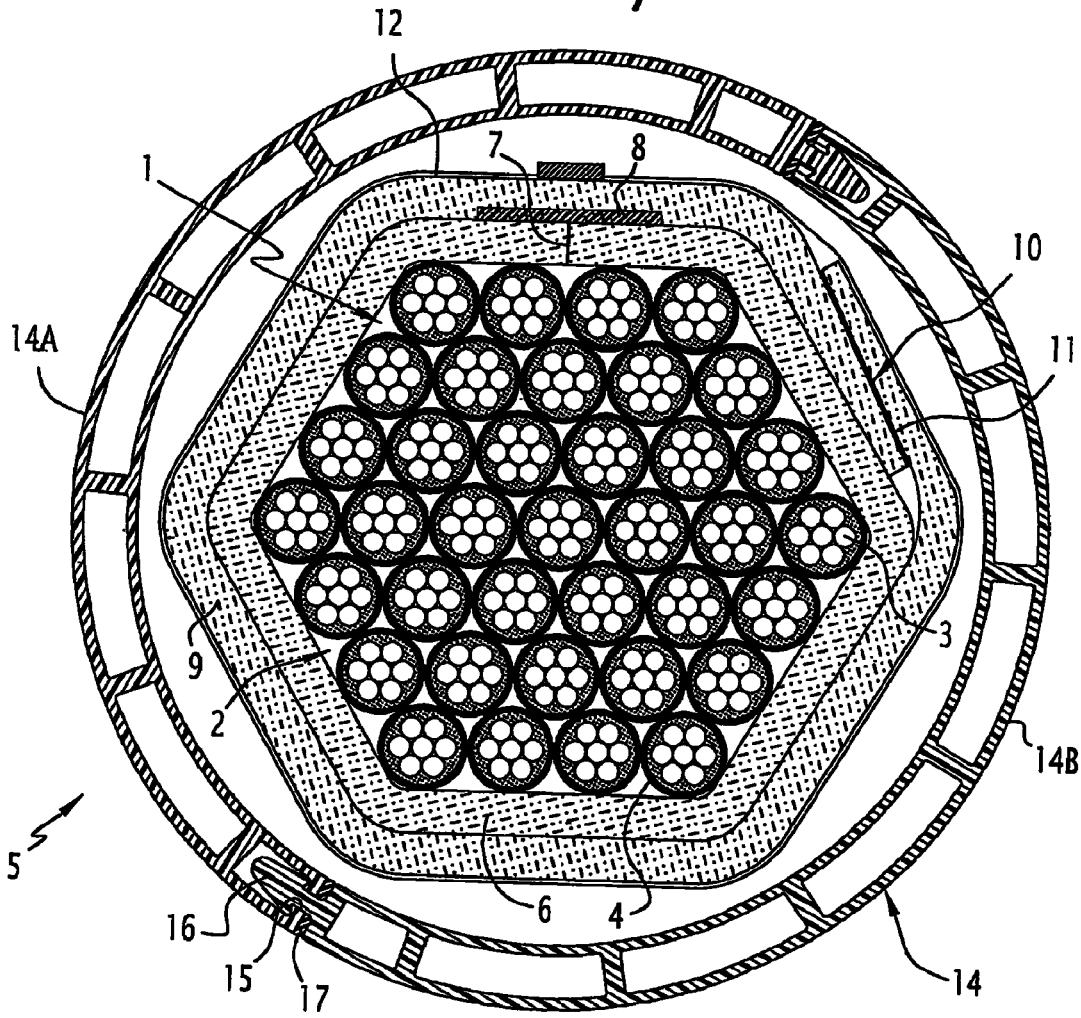
FIG. 2 is a cross-section view on line II-II of FIG. 1, on a larger scale.

The cable 1 shown in FIGS. 1 and 2 is essentially constituted by a large number of strands 2 that are placed side by side, e.g. within a generally hexagonal outline, as shown. Each strand 2 is itself made up of a plurality of individual wires 3 made of steel and surrounded by a sheath 4.

In order to protect the cable 1 from fire, a protection device 5 as described below is used.

The device 5 comprises an inner protective blanket 6 of thermally resistant material wound around the cable and closed edge to edge along a generator line 7. This inner blanket is held in place by a series of adhesive strips 8 made of fiberglass.

The device 5 also comprises an outer protective blanket 9 that is likewise made of thermally resistant material. This outer blanket is wound around the inner blanket 6 with an overlap zone 10 between its two marginal regions. This entire zone 10 is securely fastened by adhesive bonding using a layer of thermally resistant adhesive 11 such as the adhesive sold under the trademark "Mille".

Furthermore, the fastening of the outer blanket 9 is completed by a strapping using a series of steel bands 12 placed at regular intervals.

Analogous strappings (not shown) may optionally complete the fastening of the inner blanket 6 prior to putting the outer blanket into place.

As can be seen in FIG. 2, the mean generator line of the adhesively-bonded zone 10 is angularly offset with respect to the joining edges 7 of the inner blanket 6. Furthermore, as can be seen in FIG. 1, each blanket is constituted by a succession of segments that are placed end to end, and the junction planes 13A of the outer blanket are longitudinally offset relative to the junction planes 13B between the segments of the inner blanket.

In this example, each of the two blankets is constituted by a product sold under the trademark "Microtherm". It is a microporous structure constituted by particles of silica, metal oxides, and filaments of glass, this thermally insulating structure being placed within a covering of stitched glass fabric so as to form a flexible blanket.

Such an assembly having two superposed blankets can withstand 1000° C. continuously and can withstand 1200° C. during short periods of exposure to fire.

If necessary, the device may be completed by a second inner blanket analogous to the blanket 6, that is interposed between the blanket 6 and the outer blanket, and that is provided with fastening means such as the adhesive strips 8.

The fire protection device is completed by an outer shell 14 made of high density polyethylene (HDPE) serving firstly to protect the insulating blankets against moisture, and secondly to improve the overall appearance.

The shell 14 is itself made up of two identical half-shells 14A and 14B, each of which includes a groove 15 along one end generator line and a tongue 16 along the other end generator line and adapted to snap-fasten in the groove 15. To provide sealing, strips 17 forming sealing gaskets are interposed between the facing faces of the two half-shells. The shell 14 is constituted by a succession of segments that are bonded together end to end by mirror welding.

Figure 3:
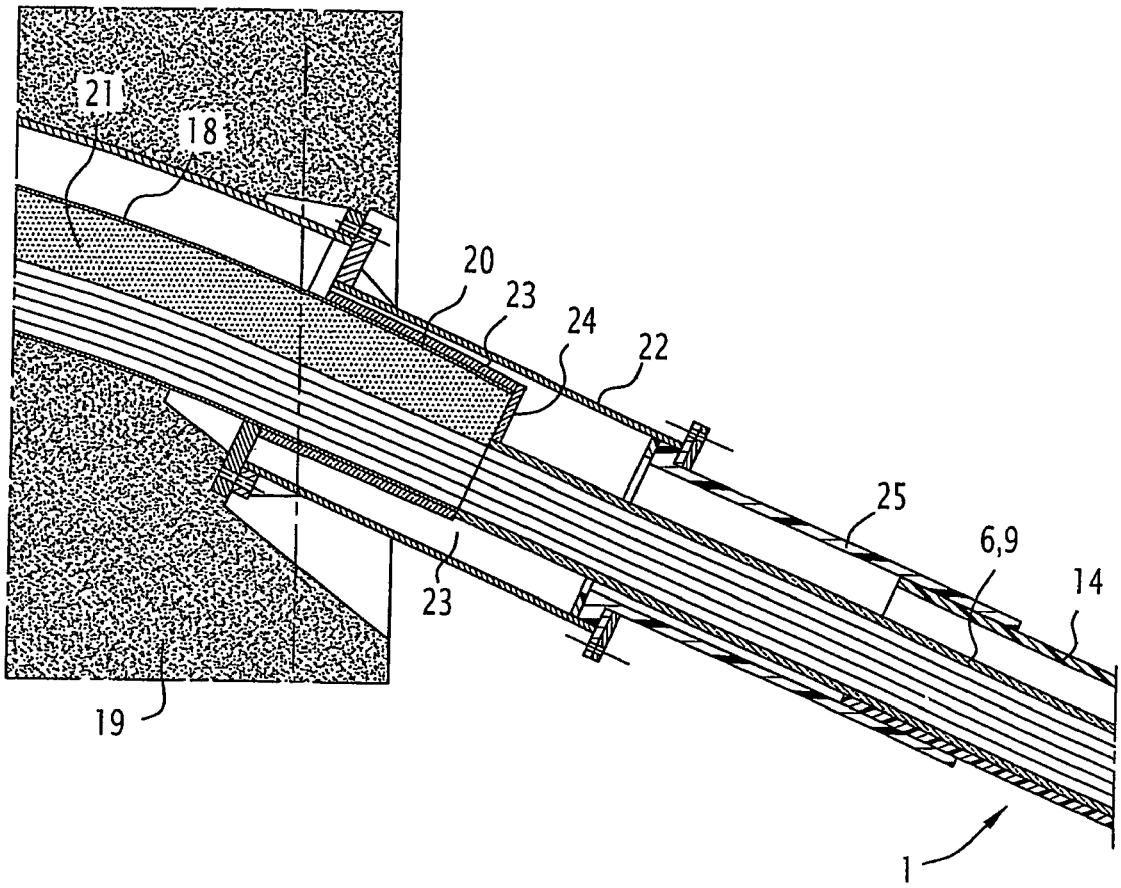
FIG. 3 is a fragmentary longitudinal section view of the passage of the cable through the deflector tube of the associated pylon.

FIG. 3 shows one end of an angled deflector tube 18 through which the middle portion of the cable passes at the top of the associated pylon 19. The tube 18 has an end portion 20 that projects out from the pylon.

In a conventional manner, the space left empty in the tube 18 is filled with a cement grout 21. The assembly comprising the two blankets 6 and 9 penetrates into a protective tube 22 that is fastened to the pylon, that surrounds the projecting portion 20, and that extends beyond it. A similar fire protection 23 is placed around the portion 20. Continuity between this additional protection and the outer blanket 9 of the main portion of the cable is provided by means of an adapter 24 made of the same Microtherm material.

In addition, the shell 14 comes to an end at a short distance from the entry of the protective tube 22, and a continuous appearance is obtained by means of a HDPE tube segment 25 that is fastened to extend the tube 22 with the end of the shell 14 being engaged therein.

Thus, fire protection is provided as far as the inside of the deflector tube and does not present any point of weakness at this location.

Similarly, the insulating blankets are extended as far as the anchor device provided at each end of the cable in the deck of the bridge.

It will readily be understood that the above-described protection device is reliable and easy to implement, both when building the bridge or during subsequent maintenance or repair operation, if any, or indeed in order to improve the fire protection that was originally provided when the bridge was built.

In particular, the two fastenings 10-11 and 12 of the outer blanket 9 provide the fire protection device with a high degree of safety.

In a variant, each segment of the shell 14 may be constituted by more than two sectors, e.g. three or four sectors.

The invention claimed is:

1. A fire protection device for a cable or the like of a civil engineering or structural work, the device comprising a blanket of thermally insulating material wound around the cable or the like, and wherein it comprises:

at least one inner blanket wound around the cable;

means for holding the inner blanket around the cable; and an outer blanket wound around the inner blanket with an overlap zone between the two longitudinal edges of the outer blanket, the overlap zone being fastened by adhesive bonding using a layer of thermally resistant adhesive.

2. A device according to claim 1, wherein it further comprises a series of steel bands constituting outer strappings for the device.

3. A device according to claim 1, wherein the inner blanket is wound edge-to-edge.

4. A device according to claim 1, wherein it further comprises a leaktight outer shell.

5. A device according to claim 4, wherein the outer shell is constituted by shell sectors that are assembled together in a leaktight manner.

6. A device according to claim 5, wherein the shell sectors include along their end generator lines both snap-fastening means and sealing means.

7. A device according to claim 1, wherein the means for holding the inner blanket comprise adhesive strips of thermally resistant material.

8. A device according to claim 1, wherein said means for holding the inner blanket comprise steel bands constituting strappings.

9. A device according to claim 1, wherein each blanket is constituted by successive segments, with the junctions between the segments of the outer blanket being longitudinally offset relative to the junctions between the segments of the inner blanket.

10. A device according to claim 1, wherein the mean generator line of the overlap zone of the outer blanket is angularly offset with respect to the closure region of the inner blanket.

11. A device according to claim 1, wherein each blanket comprises a microporous structure based on particles of silica, metal oxides, and glass filaments, the structure being placed in a covering of stitched glass fabric.

12. A civil engineering or structural work comprising a cable structure, wherein at least one cable or the like of the cable structure is provided with a fire protection device comprising a blanket of thermally insulating material wound around the cable or the like, the fire protection device comprising:

at least one inner blanket wound around the cable;

means for holding the inner blanket around the cable; and an outer blanket wound around the inner blanket with an overlap zone between the two longitudinal edges of the outer blanket, the overlap zone being fastened by adhesive bonding using a layer of thermally resistant adhesive.

13. A bridge comprising a deck, pylons, and a set of cables or the like for suspending the deck from the pylons, wherein at least one cable or the like is provided with a fire protection device comprising a blanket of thermally insulating material wound around the cable or the like, the fire protection device comprising:

at least one inner blanket wound around the cable;

means for holding the inner blanket around the cable; and an outer blanket wound around the inner blanket with an overlap zone between the two longitudinal edges of the outer blanket, the overlap zone being fastened by adhesive bonding using a layer of thermally resistant adhesive.

14. A bridge according to claim 13, wherein the pylon associated with said cable includes in its top portion a cable-deflector tube, and wherein the protection device extends onto the deflector tube.

* * * * *

UNITED STATES PATENT AND TRADEMARK OFFICE

CERTIFICATE OF CORRECTION

PATENT NO. : 7,943,217 B2
APPLICATION NO. : 12/223859
DATED : May 17, 2011
INVENTOR(S) : Jeremie Baumgartner It is certified that error appears in the above-identified patent and that said Letters Patent is hereby corrected as shown below:

Title Page

In item (73), "Efiffage TP" should read --Eiffage TP--.

Signed and Sealed this
Fourth Day of October, 2011

David J. Kappos

David J. Kappos
*Director of the United States Patent and Trademark Office*